US012623277B2

(12) United States Patent
Soulier et al.

(10) Patent No.: US 12,623,277 B2
(45) Date of Patent: May 12, 2026

(54) METHOD FOR COATING A REFRACTORY ALLOY PART, AND THE PART THUS COATED

(71) Applicants: SAFRAN, Paris (FR); COMMISSARIAT A L'ENERGIE ATOMIQUE ET AUX ENERGIES ALTERNATIVES, Paris (FR)

(72) Inventors: Mathieu Soulier, Saint Jean de Moirans (FR); Richard Laucournet, La Buisse (FR); Jacky Bancillon, Saint Egreve (FR); Alexandre Montani, Grenoble (FR); Mirna Bechelany, Moissy-Cramayel (FR); Virginie Jaquet, Moissy-Cramayel (FR); Amar Saboundji, Moissy-Cramayel (FR)

(73) Assignees: SAFRAN, Paris (FR); COMMISSARIAT L'ENERGIE ATOMIQUE ET AUX ENERGIES ALTERNATIVES, Paris (FR)

( * ) Notice: Subject to any disclaimer, the term of this patent is extended or adjusted under 35 U.S.C. 154(b) by 250 days.

(21) Appl. No.: 18/565,998

(22) PCT Filed: May 30, 2022

(86) PCT No.: PCT/FR2022/051021
§ 371 (c)(1),
(2) Date: Nov. 30, 2023

(87) PCT Pub. No.: WO2022/254139
PCT Pub. Date: Dec. 8, 2022

(65) Prior Publication Data

US 2024/0246140 A1 Jul. 25, 2024

(30) Foreign Application Priority Data

Jun. 1, 2021 (FR) ..... 2105756

(51) Int. Cl.
*B22C 9/12* (2006.01)
*B22C 3/00* (2006.01)
(Continued)

(52) U.S. Cl.
CPC ..... *B22C 9/12* (2013.01); *B22C 3/00* (2013.01); *B22C 9/10* (2013.01); *C23C 24/082* (2013.01); *C23C 28/321* (2013.01); *C23C 28/34* (2013.01)

(58) Field of Classification Search
None
See application file for complete search history.

(56) References Cited

U.S. PATENT DOCUMENTS 11,752,541 B2 * 9/2023 Bechelany ..... C04B 35/5603 164/6
2021/0299743 A1 9/2021 Bechelany et al.

FOREIGN PATENT DOCUMENTS

CN 112584946 A 3/2021
FR 3 084 894 A1 2/2020
(Continued)

OTHER PUBLICATIONS

Peter Greil, "Active-Filler-Controlled Pyrolysis of Preceramic Polymers", Journal Of The American Ceramic Society, Blackwell Publishing, Apr. 1, 1995, pp. 835-848, vol. 78, No. 4.
(Continued)

*Primary Examiner* — Daniel J. Schleis
(74) *Attorney, Agent, or Firm* — Sughrue Mion, PLLC

(57) ABSTRACT

A method includes coating of one or more zones of the refractory alloy part, using a treatment composition including one or more types of preceramic polymer, a solvent and one or more active fillers, and heat treating the coated refractory alloy part, the heat treatment allowing to partially convert the preceramic polymer to form a ceramic layer, the
(Continued)

active filler forming on a surface of the refractory alloy part, one or more ternary alloys and forming a continuous layer between the surface of the refractory alloy part and the ceramic layer obtained by conversion. The heat treatment forms a continuous layer of the ternary alloy. The treatment composition includes, relative to the total weight of the treatment composition, a weight proportion of between 40% and 66% of the one or more active fillers, and an active filler/preceramic polymer weight ratio is greater than or equal to 2.

16 Claims, 4 Drawing Sheets

(51) Int. Cl.

| | |
|---|---|
| ***B22C 9/10*** | (2006.01) |
| ***C23C 24/08*** | (2006.01) |
| ***C23C 28/00*** | (2006.01) |

(56) References Cited

FOREIGN PATENT DOCUMENTS

| | | |
|---|---|---|
| JP | 06-023476 A | 2/1994 |
| WO | 2020/085716 A1 | 4/2020 |

OTHER PUBLICATIONS

International Search Report for PCT/FR2022/051021 dated Sep. 6, 2022 [PCT/ISA/210].

Communication dated Jan. 1, 2026 issued by the State Intellectual Property Office of the P.R.China in application No. 202280039876.X.

* cited by examiner

METHOD FOR COATING A REFRACTORY ALLOY PART, AND THE PART THUS COATED

CROSS REFERENCE TO RELATED APPLICATIONS

This application is a National Stage of International Application No. PCT/FR2022/051021 filed May 30, 2022, claiming priority based on French Patent Application No. 2105756 filed Jun. 1, 2021, the contents of each of which being incorporated by reference herein in their entireties.

FIELD OF THE INVENTION

The invention lies in the field of protective coatings for refractory alloy parts subject to oxidation, for example foundry cores.

The present invention relates more precisely to a method for coating a refractory alloy part and to a part of refractory alloy coated with such a protective coating.

STATE OF THE ART

During a foundry manufacturing method, foundry cores are conventionally disposed in foundry molds, prior to the injection of the liquid metal, so as to produce one or more cavities or recesses in the mechanical elements which will be produced during this manufacturing method.

These foundry cores are conventionally made of refractory ceramics.

It is also known to use foundry cores made of refractory alloys to replace or complement the ceramic cores conventionally used.

These refractory alloy materials, typically molybdenum alloys, must be coated with a protective layer to preserve their mechanical features, particularly when they are subjected to very high temperatures encountered for example during the manufacturing processes of superalloy blades for turbomachines.

In the case of lost wax foundry methods, shells of refractory material are made around a wax model of the mechanical element to be produced, so as to form a mold of the model of this mechanical element. The wax is then evacuated into an autoclave under steam. Finally, the shell is heated to be consolidated, in order to produce an imprint of the external shape of the mechanical element to be produced.

A core can be disposed initially in the wax model and be present before the casting of the material constituting the mechanical element to be produced, the core defining the internal shape of this mechanical element.

In the case of producing turbomachine blades, typically superalloy turbine blades, by a lost wax casting method, the consolidation of the blade shell is carried out in air, at a temperature greater than 1000° C. Consequently, significant oxidation phenomena may be encountered, particularly for the refractory metal which constitutes a portion of the core or the complete core.

Molybdenum, for example, when uncoated, reacts with oxygen from 400° C., to form molybdenum dioxide ($MoO_2$) up to 650° C., then molybdenum trioxide beyond 650° C., molybdenum trioxide being very volatile. The oxidation rate of molybdenum follows a known linear increase between 400° C. and 650° C., then an exponential increase beyond and up to 1700° C.

It is also known to use for the production of a foundry core, a molybdenum-based alloy including zirconium and titanium (known under the name TZM alloy), which has a mechanical resistance greater than molybdenum at ambient temperature, which makes it more easily machinable. However, TZM is known to oxidize from 540° C. and the oxidation becomes exponential from 790° C. with rapid volatilization of TZM.

This very significant oxidation of molybdenum or TZM parts leads to a significant weight loss, and a rapid degradation of their mechanical properties.

In addition, after the consolidation of the shell in air, the superalloy used for the manufacture of the mechanical element (for example a turbomachine blade) is melted and cast under vacuum into the shell. Then it comes into contact with the refractory alloy which constitutes the core. This casting step, carried out under vacuum, at a temperature above 1500° C., results in particular in diffusion phenomena of superalloy elements in the refractory alloy of the core.

An inter-diffusion of the elements of the refractory alloy of the core towards the superalloy of the mechanical element to be manufactured can lead to a modification of the mechanical properties of the superalloy, and therefore lead to a degradation of the performance of the mechanical element obtained.

It is therefore desirable to protect these refractory alloy parts with a protective coating.

For this purpose, it is known to produce preceramic polymer coatings for protection against oxidation of metal parts made of refractory alloy. "Preceramic polymers" means polymers which, after pyrolysis, are converted into ceramic.

The "preceramic polymer" route is a synthesis method allowing the manufacture of homogeneous ceramics of high chemical purity. Due to control of the viscoelastic properties and the composition at the atomic scale of the polymers, it is in particular possible to generate ceramics of the desired shape and composition.

The best-known classes of ceramics obtained by this chemical route are the binary systems $Si_3N_4$, SiC, BN and AlN, the ternary systems SiCN, SiCO and BCN, as well as the quaternary systems SiCNO, SiBCN, SiBCO, SiAlCN and SiAlCO.

The use of ceramic precursors or "preceramic polymers" to develop protective coatings is encouraging since, compared to usual techniques, this route is carried out at a lower temperature and without sintering additives.

Appended FIG. 1 is a diagram illustrating a method for forming a coating using a preceramic polymer. This method is broken down into five steps:

1) Synthesis of a molecular precursor, or monomer M.
2) Conversion of the molecular precursor into an inorganic polymer P of controlled chemical composition and architecture, by carrying out a polymerization step. This polymer is designed to have formability (that is to say, a fusible or soluble polymer). The inorganic polymer P is preferably made up of the basic network of the ceramic, hence its name "preceramic".
3) Shaping of the polymer (that is to say the formation of the coating on the refractory alloy part) by conventional techniques, such as coating, infiltration, compaction etc. The physical and chemical properties of the preceramic polymer, such as its solubility, rheology, degree of cross-linking, and pyrolysis, largely influence the manner in which this polymer can be shaped and transformed into a defined ceramic form. The deposition of the coatings is possible in a temperature range where an adequate viscosity is reached but without the phenomenon of crosslinking and decomposition (in other words at a temperature $T<T_{R,D}$ ($T_{R,D}$ being the crosslinking and decomposition temperature)), as illustrated in appended FIG. 2.

4) Step of crosslinking the shaped polymer, which leads to obtaining an infusible solid S whose shape is capable of withstanding the subsequent steps of thermal and chemical treatment.

5) Step of ceramization of the infusible product, by thermal (and optionally chemical) treatments at high temperature. In this step carried out by means of a pyrolysis step, it is possible to distinguish a mineralization phase, in which the solid S is transformed into an inorganic mineral C1 of desired chemical composition, having a (three-dimensional) network of covalent bonds, then a crystallization phase in which the amorphous mineral is gradually organized into a polycrystalline ceramic C2 during a crystallization step.

Due to the significant difference in density between polymers (1 to 1.2 $g \cdot cm^{-1}$) and ceramic materials (2-3 $g \cdot cm^{-1}$), linear shrinkage of more than 30% generally results in an extensive cracking and significant porosity in the ceramic coating obtained.

The appearance of cracks in the ceramic coating obtained is particularly detrimental to its effectiveness. In particular, any through crack in this coating places the refractory alloy part in contact with the oxidizing atmosphere and renders the oxidation protection of the coating obsolete.

To overcome this problem, a modification method, called AFCOP (from "*Active Filler Controlled Polymer pyrolysis*") was developed by Greil. Reference can be made to the following publication: Active-Filler-Controlled Pyrolysis of Preceramic Polymers, P. Greil, J. Am. Ceram. Soc. 1995. 78: p. 835-48. According to this method, the polymer is partially filled with inert or active powder particles, to reduce shrinkage and to enable the production of quality ceramic parts. Active fillers such as Ti, Nb, Cr, Mo, B, $MoSi_2$ incorporated into the polymer can reduce the shrinkage caused during the conversion of the polymer into ceramic, by reacting with solid and gas decomposition products of the polymeric precursor and/or the pyrolysis atmosphere to form carbides, oxides, nitrides or silicides. This reaction can in fact occur with an expansion of the filler particles, which neutralizes the shrinkage during densification, and leads to a ceramic composite as close as possible to its final form.

A method for coating a refractory alloy part is also known from document FR 3 084 894, said method consists in coating this part using a treatment composition comprising at least one type of preceramic polymer, a solvent and active fillers, then subjecting said coated part to a heat treatment allowing to at least partially convert the preceramic polymer into ceramic and to form a coating, the latter being configured to protect the refractory alloy from oxidation.

This method consists of using a low weight proportion of active filler, less than 35%. Analyzes of the protective coatings thus obtained showed that a discontinuous protective layer of a binary alloy resulting from the co-reactivity of this active filler with the refractory alloy part is obtained on the refractory alloy part, this discontinuous layer being covered with a layer of ceramic resulting from the conversion of the preceramic polymer. The reactivity of the active filler with respect to the substrate is limited because this filler is coated in the preceramic polymer which obstructs inter-diffusion.

In appended FIG. 3 which is a scanning electron microscope (SEM) view, it can be seen that a part made of refractory molybdenum (Mo) alloy, covered with a discontinuous layer of binary alloy $Mo_5Si_3$ (resulting from the co-reactivity of an active silicon filler with molybdenum) then of a continuous layer of SiOC ceramic. However, the ceramic layer can sometimes be too porous and cracked to provide protection and the binary alloy layer below being discontinuous, this coating is ineffective in providing the desired protection against oxidation.

DISCLOSURE OF THE INVENTION

A purpose of the invention is therefore to form a protective coating for a refractory alloy part, which is effective in protecting this part against oxidation.

To this end, the invention relates to a method for coating a refractory alloy part, comprising steps:

- of coating of at least one zone of said part, using a treatment composition comprising at least one type of preceramic polymer, a solvent and at least one active filler,
- of heat treatment of the part coated with the treatment composition, this heat treatment allowing to at least partially convert the preceramic polymer to form a ceramic layer.

In accordance with the invention, said treatment composition comprises, relative to its total weight, a weight proportion of between 40% and 66% of at least one active filler, the active filler/preceramic polymer weight ratio is greater than or equal to 2, said active filler is chosen to form, by solid or liquid diffusion, on the surface of said refractory alloy part, at least one alloy which is at least ternary resulting from the co-reactivity of this active filler with the refractory alloy part and the preceramic polymer, this at least ternary alloy forming a continuous layer between the surface of the refractory alloy part and the ceramic layer obtained by conversion and the heat treatment is carried out so as to form this continuous layer of at least ternary alloy, which protects said refractory alloy part from oxidation.

Thanks to these features of the invention, and in particular thanks to the use of a higher weight proportion of active filler (at least 40%) and compliance with the active filler/preceramic polymer weight ratio greater than or equal to 2, it is possible to obtain on the surface of the refractory alloy part, a continuous layer of an at least ternary alloy, under the ceramic layer, this continuous layer effectively protects the refractory alloy part against oxidation and/or corrosion by molten metals. The active filler is selected to react with both the substrate and the preceramic polymer (or its ceramic conversion products). The co-reactivity of the preceramic polymer allows it to participate in the formation of a continuous layer at the Si—O—C interface and the substrate (instead of being an obstacle to diffusion).

According to other advantageous and non-limiting features of the invention, taken alone or in combination:

- said treatment composition comprises, relative to its total weight, a weight proportion of between 45% and 60% of at least one active filler and in that the active filler/preceramic polymer weight ratio is comprised between 2 and 3;
- said treatment composition comprises, relative to its total weight, a weight proportion of between 55% and 60% of at least one active filler and in that the active filler/preceramic polymer weight ratio is comprised between 2 and 2.5;
- said at least one active filler is selected from silicon powder, aluminum powder, iron powder, copper powder, cobalt powder, nickel powder, lanthanum powder, germanium powder, zirconium powder, chromium powder, titanium powder, hafnium powder, lanthanum powder and rhenium powder;

the preceramic polymer is selected from siloxanes, polysiloxanes with high ceramization yield which are converted into silica ($SiO_2$) or silicon oxycarbide (Si—O—C) by pyrolysis, polysilazanes or polycarbosilanes;

the treatment composition further comprises fillers called passive fillers, configured to modulate the thermal expansion coefficient of the at least ternary alloy layer, so as to have a difference between the thermal expansion coefficient of the refractory alloy part and the thermal expansion coefficient of the at least ternary alloy layer less than $3.10^{-6}$ $K^{-1}$;

the method comprises at least one first coating step and one second consecutive coating step, and at least one heat treatment step carried out between two consecutive coating steps, the heat treatment step being a step of crosslinking the preceramic polymer(s), configured to generate an infusible polymer network capable of withstanding subsequent pyrolysis steps, the second coating step being applied to obtain a thicker treatment composition layer;

the treatment composition used during the second coating step has a viscosity lower than the viscosity of the treatment composition used during the first coating step;

the crosslinking step is carried out in the presence of air at a temperature greater than or equal to the highest crosslinking temperature among the different crosslinking temperatures of the different species of preceramic polymer of the treatment solution;

the heat treatment step comprises the steps of:

crosslinking at a first temperature configured to evaporate the solvent and thus accelerate the crosslinking, conversion carried out at a second temperature, higher than the first, configured to convert the polymer into ceramic and eliminate the organic species, so as to obtain a ceramic having an amorphous structure, structuring carried out at a third temperature, higher than the second, configured to convert the ceramic with an amorphous structure into ceramic having a crystalline structure;

the heat treatment step is carried out under a controlled atmosphere so as to avoid oxidation of the refractory alloy part, while having an oxygen partial pressure sufficient to ensure the conversion of the preceramic polymer into oxycarbide ceramic or oxide ceramic;

the ceramic layer obtained by conversion is removed after the heat treatment, by mechanical or chemical action to leave only the at least ternary alloy layer.

The invention also relates to a refractory alloy part, in particular based on molybdenum.

In accordance with the invention, this part is obtained by the aforementioned coating method and it is coated with a continuous layer of at least one alloy which is at least ternary resulting from the co-reactivity of the active filler with the refractory alloy part and the preceramic polymer, and a ceramic layer, the continuous layer of at least one alloy which is at least ternary being disposed between the refractory alloy part and the ceramic layer.

This part is for example a foundry core made of refractory alloy.

DESCRIPTION OF THE FIGURES

Other features, aims and advantages of the invention will emerge from the description which follows, which is purely illustrative and not limiting, and which must be read with reference to the appended drawings in which.

DETAILED DESCRIPTION OF THE INVENTION

The method in accordance with the invention can be applied to any type of refractory alloy part, in particular a refractory alloy based on molybdenum or a refractory alloy including molybdenum as the majority element, for example the titanium-zirconium-molybdenum alloy (TZM), in order to protect this part from oxidation, in particular in the presence of high temperatures (above 400° C.) and air.

Such a part is for example a mechanical part, such as for example a foundry core or a heating element of a furnace. In the case of a foundry core, the invention can be applied to a foundry core made of refractory alloy used for example to produce a superalloy turbomachine blade.

Figure 1:
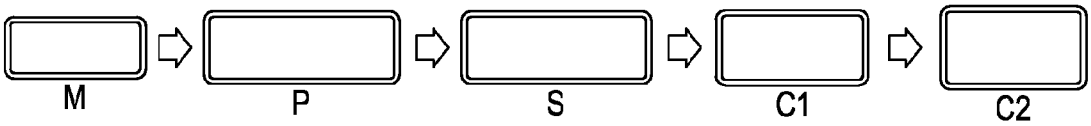
FIG. 1 is a schematic representation of the steps of a coating using a preceramic polymer according to the prior art.
Figure 2:
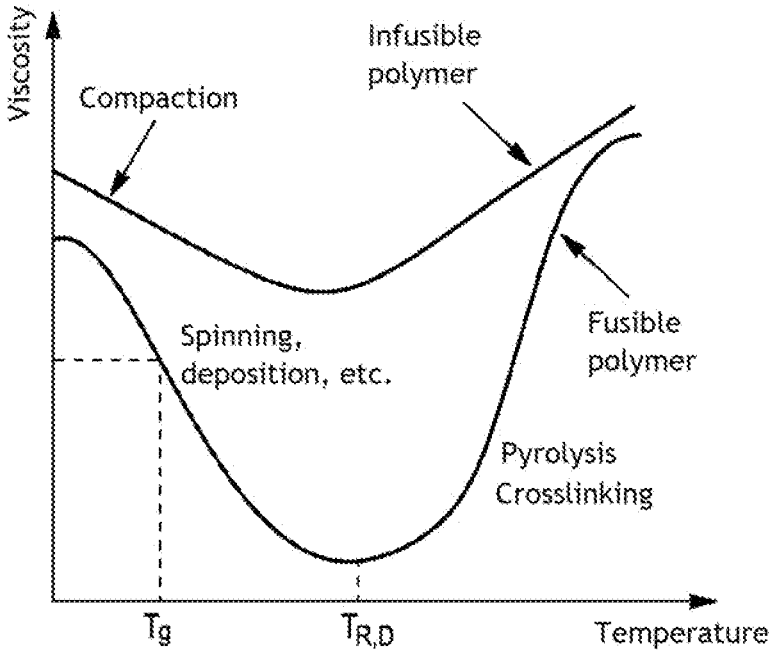
FIG. 2 a state diagram of a preceramic polymer as a function of viscosity and temperature.
Figure 3:
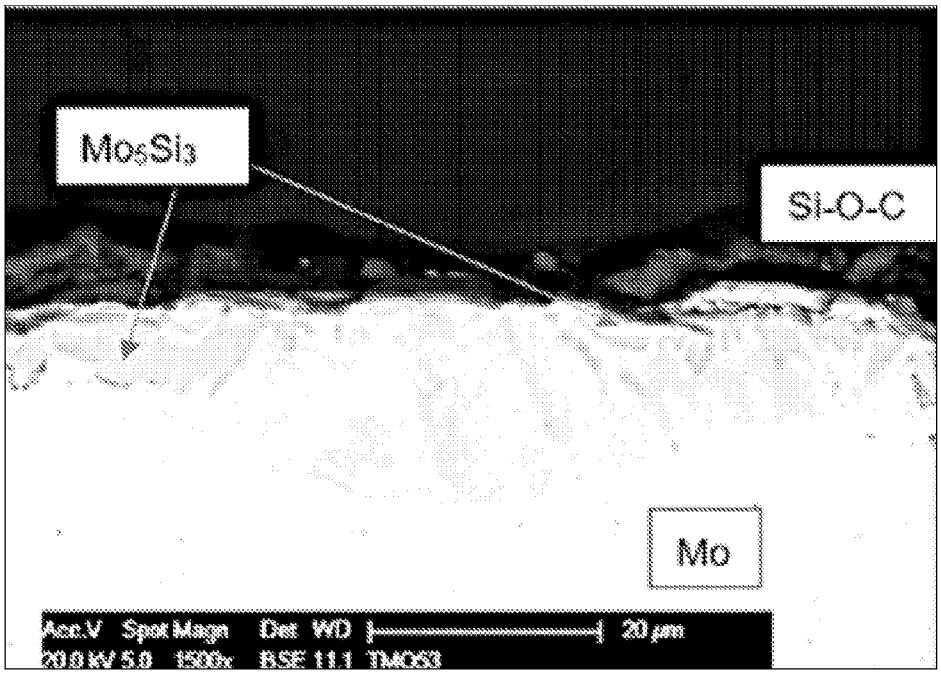
FIG. 3 is a sectional view using a scanning electron microscope of a part obtained by a method according to the prior art.
Figure 4:
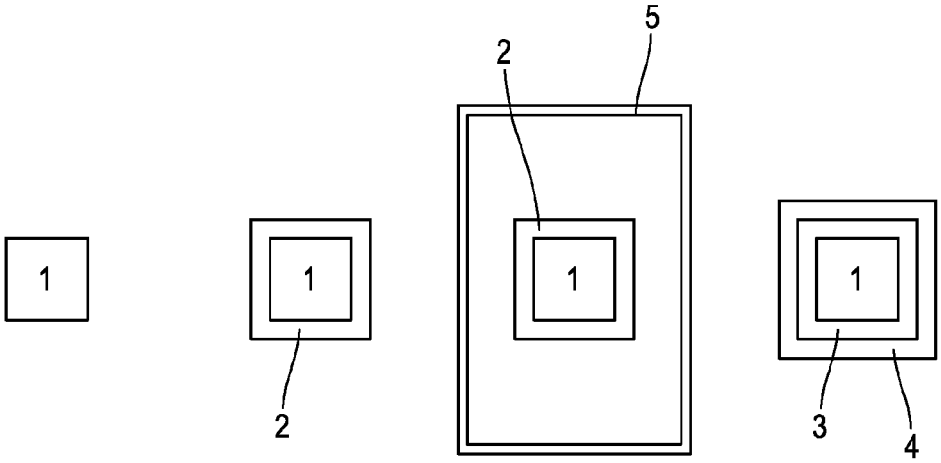
FIG. 4 is a diagram representing the different steps of the method according to the invention.

As can be seen in FIG. 4, the coating method in accordance with the invention comprises steps:

of coating of at least one zone of a refractory alloy part 1, preferably the entire part, using a treatment composition 2 comprising at least one type of preceramic polymer, a solvent and at least one active filler, this composition and the weight proportions of its different constituents being described subsequently, of heat treatment of the part 1 coated with the treatment composition 2, so as to at least partially convert the preceramic polymer into ceramic and to form, around said part, a coating which protects it from oxidation.

More precisely, this heat treatment allows to form, by solid or liquid diffusion, on the surface of said refractory alloy part 1:

at least one alloy which is at least ternary resulting from the co-reactivity of this active filler with the refractory alloy part 1 and the preceramic polymer, and a ceramic layer 4 obtained by conversion, this at least ternary alloy forming a continuous layer 3 between the surface of the refractory alloy part 1 and the ceramic layer 4 obtained by conversion.

Treatment Composition.

The treatment composition 2 comprises, in relation to its total weight, a weight proportion of between 40% and 66% of at least one active filler, and the active filler/preceramic polymer weight ratio is greater than or equal to 2.

Advantageously, the weight proportion of solvent will be selected to adjust the viscosity of the treatment composition and make it compatible with the chosen printing method.

More preferably, the treatment composition 2 comprises a weight proportion of active filler(s) comprised between 45% and 60% and a weight ratio of active filler/preceramic polymer comprised between 2 and 3. The amount of solvent is to be adjusted according to the printing method chosen (on the 10-40% range).

Even more preferably, the treatment composition 2 comprises a weight proportion of active filler(s) comprised between 55% and 60% and a weight ratio of active filler/preceramic polymer comprised between 2 and 2.5.

Preceramic Polymer.

The preceramic polymer advantageously comprises polysiloxanes with high ceramization yield which are converted into silica ($SiO_2$) or silicon oxycarbide (Si—O—C) by pyrolysis but can also be selected from polysilazanes or polycarbosilanes. By "high ceramization yield", it is understood that the theoretical rate of conversion into ceramic, silicon dioxide $SiO_2$ or silicon oxycarbide Si—O—C is at least 70% by weight, preferably at least 80%.

Mention can for example and preferably be made of the commercial reference siloxanes SILRES® from the company Wacker.

Solvent.

The solvent is preferably organic and may comprise, for example, a solvent or a combination of solvents selected from glycol ethers, terpineol, butanone, methyl ethyl ketone (MEK), acetone, benzene, xylene, toluene or other organic solvents.

It is possible to adapt the viscosity of the treatment composition 2 by modifying the type of solvent used, or the proportion of solvent in this treatment composition.

Active Fillers.

The active filler(s) used are selected so that at least one of them reacts with the refractory alloy part and with the preceramic polymer during the heat treatment which will be described below. By "reaction with the preceramic polymer" it is understood that the active filler and the refractory alloy part co-react with the solid and gas decomposition products of this preceramic polymer and/or with the atmosphere of the pyrolysis of the preceramic polymer which leads to the formation of ceramics.

These elements interdiffuse on the surface of the refractory alloy part 1 by diffusion to form one or more alloys, at least one of which is an at least ternary alloy which is in the form of a continuous layer consisting of:

- an atomic element of the polymer chain of the preceramic polymer or of one of these polymers if there are several,
- one or more atomic elements of the coated refractory alloy metal part,
- one or more atomic elements of the active filler or incorporated active fillers.

This continuous layer 3 is formed directly in contact with the refractory alloy metal part 1 and is formed under the ceramic layer 4 formed.

"At least ternary alloy" means a ternary alloy composed of three different atomic elements, or any other alloy composed of more than three different atomic elements, for example a quaternary alloy or more.

This continuous layer 3 of at least ternary alloy is then capable of generating a passivating oxide layer when subjected to oxidizing conditions.

Thus, during the life cycle of the part 1, in the case where the ceramic layer formed 4 has open porosities allowing oxygen to pass therethrough or if it flakes or cracks, the alloy continuous layer 3 formed is locally exposed to external conditions. When the environmental conditions are oxidizing, this at least ternary alloy 3 generates a passivating oxide layer on the surface, capable of protecting the part 1 against oxidation and the diffusion of external species.

This healing effect therefore allows to greatly increase the lifespan of the refractory alloy part 1.

The active metal fillers may advantageously contain one species or a combination of several of the species listed below: silicon powder, aluminum powder, iron powder, copper powder, cobalt powder, nickel powder, lanthanum powder, germanium powder, zirconium powder, chromium powder, titanium powder, hafnium powder, lanthanum powder, rhenium powder.

In order to obtain a homogeneous coating and to optimize the contact surface between the active fillers present in the at least ternary alloy and the refractory alloy part 1 and to facilitate diffusion, the particle size of the active fillers in the treatment composition 2 before thermal conversion is preferably selected to be less than 20 microns, more preferably less than 10 microns. If necessary, grinding the active fillers can be carried out to lower the particle size below this threshold of 20 microns.

The at least ternary alloys (layer 3) formed on the surface of the part 1 by solid diffusion of the active filler(s) of the composition 2 in this part 1 are thermodynamically stable compounds. The alloys likely to be formed are defined by the phase diagrams between its active fillers and the part 1 to be covered. The excess preceramic polymer forms, after pyrolysis, a continuous ceramic layer on the surface of the part 1. This generally porous ceramic layer can act as a thermal barrier for the part 1 or even have an impact on the corrosion resistance of the part 1 by modifying the wettability of the part 1 thus coated with respect to a molten metal in contact.

Several examples are mentioned below.

By way of example, the treatment composition 2 may contain as active filler a germanium powder and as preceramic polymer, a polysiloxane and a solvent, all while respecting the weight proportions and weight ratios in accordance with the aforementioned invention.

When the part 1 is made of molybdenum or a molybdenum-based alloy including zirconium and titanium (TZM alloy), and it is coated with said composition 2 by coating, then it undergoes the heat treatment according to the invention and which will be described later, then a continuous layer 3 of a ternary alloy of $Mo(Si_xGe_{1-x})_2$ is formed on the surface of said part 1, this layer 3 being surmounted by the ceramic layer 4 formed by conversion of the preceramic polymer ($SiO_2$ and/or SiOC phase as a function of the partial oxygen pressure during the heat treatment). The source of silicon to form this ternary alloy comes from the products of the pyrolysis of the preceramic polymer. This layer of ternary alloy 3 is capable of forming a passivating layer of silica under oxidizing conditions, as mentioned previously.

As another example, the treatment composition 2 may contain as active filler, a cobalt powder and as preceramic polymer, a polysiloxane and a solvent, all while respecting the weight proportions and weight ratios in accordance with the aforementioned invention.

When the part 1 is made of molybdenum or a molybdenum-based alloy including zirconium and titanium (TZM alloy), and it is coated with said composition 2 by coating, then it undergoes the heat treatment according to the invention and which will be described later, then a continuous layer 3 of a ternary alloy of $Co_3Mo_2Si$ is formed on the surface of said part 1, this layer 3 being surmounted by the ceramic layer 4 formed by conversion of the preceramic polymer ($SiO_2$ and/or SiOC phase as a function of the oxygen partial pressure during heat treatment). The source of silicon to form this ternary alloy comes from the products of the pyrolysis of the preceramic polymer.

Cobalt-based coatings are used to protect parts against wear or corrosion by forming a passivating layer of chromium (III) oxide, $Cr_2O_3$.

As yet another example, the treatment composition 2 may contain as active filler, an aluminum powder and as preceramic polymer, a polysiloxane and a solvent, all while respecting the aforementioned weight proportions and weight ratios in accordance with the invention.

When the part 1 is made of molybdenum or a molybdenum-based alloy including zirconium and titanium (TZM alloy), and it is coated with said composition 2 by coating, then it undergoes the heat treatment according to the invention and which will be described later, then a continuous layer 3 of a ternary alloy of $Mo(Si_xAl_{1-x})_2$ is formed on the surface of said part 1, this layer 3 being surmounted by the ceramic layer 4 formed by conversion of the preceramic polymer ($SiO_2$ and/or SiOC phase as a function of the oxygen partial pressure during heat treatment). The silicon source to form this ternary alloy comes from the products of the pyrolysis of the preceramic polymer.

This ternary alloy layer is capable of forming a passivating layer of silica and alumina under oxidizing conditions, as mentioned previously, in ratios which depend on the respective contents of aluminum and silicon in the ternary alloy.

Optional Passive Fillers.

It is also possible to add to the aforementioned treatment composition 2 one or more passive fillers, up to 30% by weight of the total weight. However, this weight percentage of passive filler(s) will be adapted according to the quantities of active filler(s) used, and the maximum will therefore, in certain cases, be less than 30% by weight.

A passive filler allows to prevent excessive shrinkage caused by ceramization during heat treatment carried out after coating.

The passive fillers also allow to modulate the thermal expansion coefficient of the at least ternary alloy layer 3, depending on the properties of the covered part 1, in particular so as to avoid gradients in thermal expansion coefficients at the interface between the layer 3 and the part 1. A difference in thermal expansion coefficient less than $3.10^{-6}\ K^{-1}$ between the part 1 and the at least ternary alloy layer 3 and a difference in thermal expansion coefficient less than $3.10^{-6}\ K^{-1}$ between the at least ternary alloy layer 3 and the ceramic layer 4 allow to avoid delamination and cracking during heat treatments.

Indeed, a sudden variation in thermal expansion coefficient can lead to delamination or separation of the coating (that is to say layer 3 or layer 4) during significant thermal variations.

Optionally, but advantageously, in the case where the part 1 is a foundry core made of refractory alloy, the passive filler(s) include ceramic fillers originating partly or totally from the composition of the ceramic cores conventionally used, for example zircon, alumina or silica, but also other oxides, for example aluminosilicates, calcite, magnesia, or other unlisted species or a mixture thereof. Examples of ceramic compositions can be found in U.S. Pat. No. 5,043,014.

Thus, during the demoulding of a foundry product, the removal of the foundry cores can be simplified. Indeed, if the ceramic layer 4 was obtained using a composition 2 with passive fillers including ceramic fillers, as mentioned above, then it will be possible to dissolve this ceramic layer 4 using a basic dissolvent, as was done in the prior art for ceramic foundry cores. Thus, there will be clearance between the foundry product (for example a blade) and the foundry core constituting the part 1 and it will be easier to unmold the foundry product.

Oxides could also be used as passive fillers: zircon, zirconia, mullite, alumina or silica, but also other oxides, for example aluminosilicates, calcite, magnesia, or a mixture of thereof, carbides for example SiC or nitrides, for example $Si_3N_4$.

Coating.

The coating of part 1 can be carried out following a method including one or more coating steps, which can in turn be carried out by the same method or by different methods.

The choice of the coating method depends in particular on the viscosity of the treatment composition 2, the size and complexity of the geometry of the part 1 to be covered and its surface condition.

In addition, the thickness of the desired layer influences the choice of the coating method.

The coating is preferably carried out by spinning, dipping or spraying.

Spin coating allows to obtain a thin homogeneous layer on a flat surface of a part 1. The thickness of the deposited layer can also be adjusted by modifying the rotation speed of the part 1.

To produce a thick layer, it is also possible to adapt the viscosity of the treatment composition 2, in addition to reducing the rotation speed of the part 1.

For complex geometries, the coating step is advantageously carried out by dipping, the part 1 being dipped in a bath of treatment composition 2, so as to cover the entire surface of the part 1 with a layer of treatment composition 2.

Finally, the spraying is carried out using a spraying device which locally projects the treatment composition 2 onto a zone of the part to be treated 1, so as to cover said zone with a layer of treatment composition 2. The spraying advantageously applies to parts with complex geometries, in particular when it is not necessary or it is desired to avoid carrying out a coating on the entire surface of the part 1.

Dip or spray coating methods are also suitable for parts 1 having a simple geometry.

Finally, it should be noted that the treatment composition 2 can also be deposited by different printing methods which facilitate the covering of complex parts 1 at reduced costs. These printing methods are for example selected from electrophoresis, spin coating, spray coating and suspension plasma spraying.

Preferably, the method in accordance with the invention is carried out so as to have an overall thickness of the alloy layer 3 and the ceramic layer 4 less than 5 μm, so as to guarantee that the ceramic layer 4 remains intact. Above this thickness and even more so above 50 μm, cracking and delamination phenomena of the ceramic layer 4 may occur.

However, in the context of the method in accordance with the invention, the at least ternary alloy layer 3 obtained is continuous. Consequently, it is possible to have an overall layer (layers 3 and 4) with a thickness greater than the aforementioned thickness of 50 μm, since in this case, the cracking of layer 4 is not critical, the alloy layer 3 ensuring the protection of the part 1 against oxidation.

Multiple Layers.

To obtain thick coatings without defects up to a thickness of several hundred microns, it is possible to carry out several successive coating steps, by producing a plurality of layers deposited with or without intermediate heat treatment.

The viscosity of the treatment composition 2 is advantageously reduced at each coating iteration in order to fill the porosity of the previous layer.

Between each coating pass, a step of crosslinking (heat treatment) the coating can advantageously be carried out.

During the crosslinking step, the part 1 is heated in the presence of air at a crosslinking temperature (from 100° C. to 200° C.) of the preceramic polymer(s) contained in the treatment composition 2.

If the preceramic polymers used have a different crosslinking temperature, the crosslinking will be carried out at the highest crosslinking temperature among the crosslinking temperatures of the species present.

The coating of a part 1 is carried out with as many coating passes as necessary to obtain a desired coating.

Heat Treatment.

The method for transforming preceramic polymers into ceramics is a complex approach. Several factors can vary and modify the composition, microstructure, density, ceramic yield and properties of ceramics derived from preceramic polymers. Among these factors, mention can be made of:

- rheology, ceramic yield, reactivity and precursor crosslinking degree,
- the pyrolysis atmosphere (inert/reactive/vacuum) during shaping and/or during ceramization,
- the gas pressure during ceramization,
- the heating speed,
- the heating temperature,
- the duration of the plateau.

After the coating step, the preceramic polymer of the treatment composition 2 is converted by heat treatment into ceramic.

The part 1, covered with the composition 2, is disposed in an enclosure 5 which is brought to a temperature required for the treatment. Advantageously, this enclosure 5 is hermetic and contains a gas that is inert with respect to the part 1 or the treatment composition 2.

The heat treatment of the preceramic polymer is preferably carried out in a non-oxidizing atmosphere for the part 1, but the oxygen partial pressure of which is sufficient to convert the preceramic polymer into ceramic, in particular into oxycarbide ceramic or oxide ceramic.

For example, the partial pressure range of dioxygen can be comprised between $10^{-5}$ bar and $10^{-30}$ bar for a pyrolysis treatment carried out at 1350° C.

The heat treatment may include several steps, namely a crosslinking step, a conversion step and a structuring step.

A crosslinking step is preferably carried out after the coating step and before any other heat treatment step.

The crosslinking step allows in particular to vaporize the solvent and to cause the crosslinking of the preceramic polymer. This crosslinking step generates a low content of organic groups which improves the ceramic yield and avoids too sudden variations in density and volume during the conversion.

This treatment is carried out at a first temperature, preferably between 100° C. and 400° C., more preferably at a temperature around 200° C.

Optionally, the crosslinking can be induced by ultraviolet radiation.

A conversion step is carried out to convert the polymer into ceramic. This conversion leads to the decomposition and elimination of organic moieties (such as methyl, ethyl, phenyl or vinyl) and Si—H or Si—NHx groups during treatment.

The conversion step is preferably carried out at a second temperature higher than the first, for example comprised between 600° C. and 800° C. After the conversion step an amorphous structure is obtained.

Following the conversion step, a structuring step is carried out, at a third temperature, higher than the second and selected to define the final crystal structure, the microstructure and the properties of the coating. Preferably, the structuring step is carried out at a temperature comprised between 1000° C. and 1350° C.

Different treatment techniques can be used to carry out one or more steps of the aforementioned heat treatment.

Pyrolysis, for example induced by a laser, is advantageously used for parts 1 having a low melting temperature, and to generate ceramic depositions with specific compositions.

Ion beam treatment is advantageously used to control the breaking of chemical bonds and the crosslinking of the preceramic polymer.

The heat treatment of the refractory alloy part 1 (whether it is molybdenum or molybdenum alloy), coated with the composition 2, is configured and carried out so as to ensure the conversion into ceramic 4 of all or a portion of the preceramic polymer contained in the treatment composition 2 and to allow the co-reactivity of the products of the decomposition of the preceramic polymer with the active filler and with the part 1.

Finally, it will be noted that it is possible to remove the ceramic layer 4 obtained by conversion after the heat treatment, by mechanical or chemical action, to retain only the continuous layer 3. Indeed, the layer 4 is potentially less adherent than the layer 3 and may delaminate over time or wear out more quickly than the layer 3.

Example of Producing a Coating:

A treatment composition 2 was prepared comprising, relative to its total weight:

- 37% by weight of Terpineol solvent,
- 18.5% by weight of SILRES MK® (preceramic polysiloxane polymer, having a theoretical rate of conversion into ceramic into silicon dioxide SiO2 or into silicon oxycarbide Si—O—C of 80% by weight),
- 44.5% by weight of aluminum (active filler), whose particle size is less than 20 microns.

The weight ratio of active filler/preceramic polymer is equal to 44.5/18.5, or 2.4, that is to say greater than or equal to 2.

Firstly, the dissolution of the preceramic polymer in the Terpineol solvent is carried out at 60° C., with magnetic stirring, in a beaker for a minimum of 30 minutes. The aluminum powder is then added and stirring is maintained for at least 12 hours.

The treatment composition 2 is then cooled and stabilized between 19° C. and 21° C. during the dipping phase and also kept under magnetic stirring.

The part 1 made of molybdenum or molybdenum alloy is introduced into the treatment composition 2 at a speed of 10 mm/min, maintained for 30 seconds in the formulation, then exited at a speed of 10 mm/min.

When the part has completely emerged from the treatment composition 2, it is dried in hot air (between 150° C. and 220° C.) until the solvent evaporates. A total of six successive dippings with intermediate hot air drying were carried out to obtain a perfectly continuous coating with a thickness of 40 to 50 microns.

The part is then subjected to a crosslinking heat treatment in air for 1 hour, at a temperature comprised between 170° C. and 230° C., for example at 200° C.

If necessary, additional dipping/drying/crosslinking steps can be added using the same treatment composition 2 or a more diluted treatment composition 2, to obtain a deposition matching the contour of the part 1 to be coated. In this way, any cracks in a first layer of the coating will be filled with an additional layer of coating, thus creating a crack-free coating.

The heat treatment must lead to the partial or total conversion of the SILRES MK® into ceramic but also allow the reactivity of the solid and gas silicon decomposition products of the SILRES with the part 1 and the active aluminum filler. The heat treatment plateau time must be sufficient to then allow interdiffusion in the molybdenum or molybdenum base support to form a continuous layer of ternary molybdenum-silicon-aluminum alloy. In either case, the heat treatments can optionally be carried out during the same thermal cycle in a tubular alumina furnace under argon sweeping at a flowrate of 35 to 40 L/h.

This allows in particular to reduce the number of steps of the method and thus to reduce its duration and therefore its cost.

In this example, the thermal cycle imposed on the coated part is carried out in a tubular alumina furnace and includes temperature rise and fall ramps of 200° C./h and a 15-hour plateau at 900° C. under argon sweeping of 35 L/h. A zirconium oxygen monitor is placed upstream of the part relative to the argon flow to prevent oxidation of the molybdenum part during heat treatment.

Figure 5:
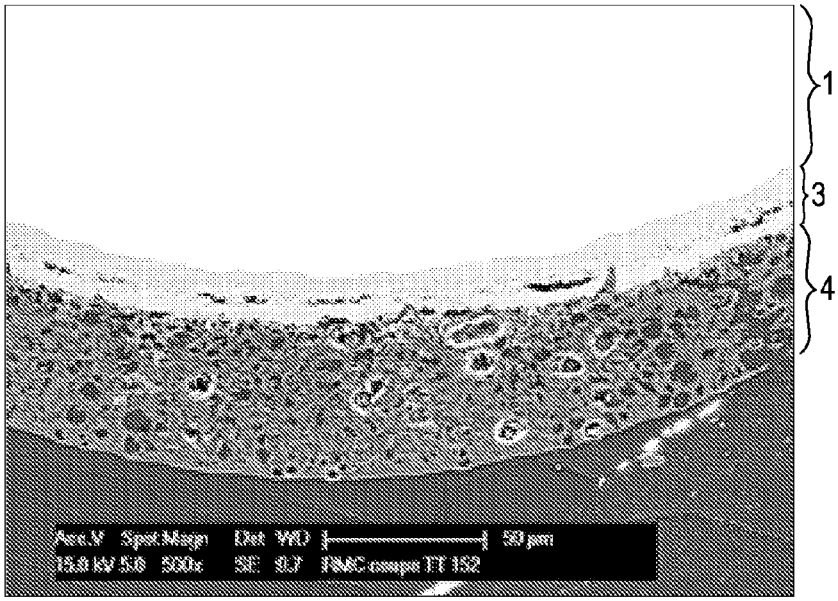
FIG. 5 is a sectional view using a scanning electron microscope of a first part obtained by a method according to the invention.

FIG. 5 shows a sectional view, obtained by scanning electron microscope (SEM), of a molybdenum rod 1 coated with the composition of the example mentioned above, after heat treatment. The solution results in a multi-layer metal/ceramic coating.

This FIG. 5 shows the molybdenum rod 1, a continuous layer 3 formed of different alloys, including at least one resulting from the reactivity between the part 1, the active filler (here aluminum) and the ceramic 4 resulting from the conversion of the preceramic polymer.

The ceramic portion 4 is made up of a layer less than 50 microns of heterogeneous compositions: the matrix is made up of silicon oxycarbide (Si—O—C) resulting from the conversion of the preceramic polymer into ceramic. The layer also includes inclusions of aluminum (residue of the active filler of the formulation which has not reacted because it is too far from the rod), free carbon (product of decomposition of the preceramic polymer), silica (idem) and possibly polysiloxane if the conversion of the initial preceramic polymer is not complete.

Figure 6:
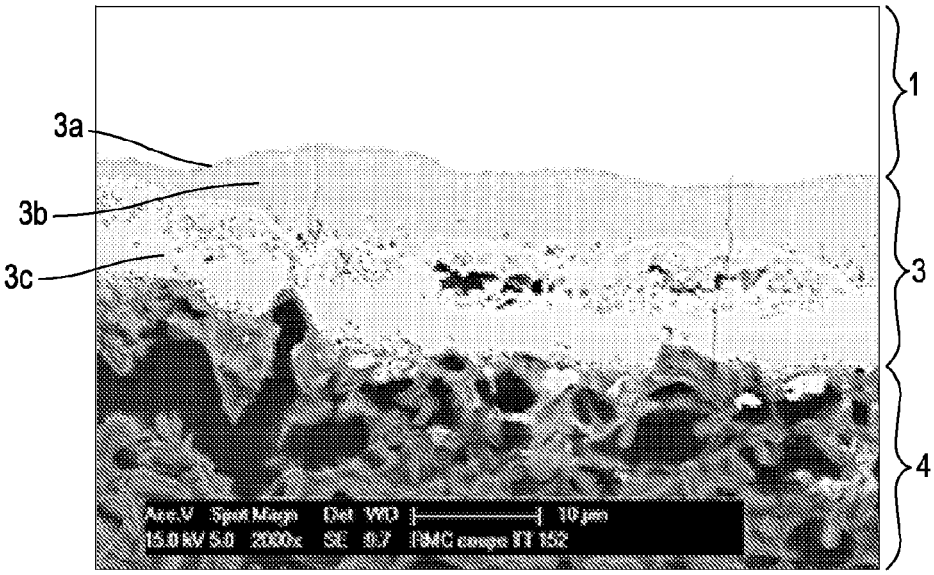
FIG. 6 is a detailed view of FIG. 5.

FIG. 6 which is a close-up view of FIG. 5, shows that layer 3 of the coating is composed of three main alloy phases (listed from the rod 1 outwards):

- a continuous layer 3*a* of solid solution of aluminum and silicon in molybdenum (<2 microns). The Al content in this layer is less than 35 atomic % and the silicon content less than 25 atomic %;
- a layer 3*b* less than 10 microns of binary alloy $Al_8Mo_3$ resulting from the reactivity between the active filler and the molybdenum support.
- a layer 3*c* less than 10 microns of ternary alloy $Mo(Si,Al)_2$ whose silicon comes from the atmosphere of the pyrolysis of the preceramic polymer and/or its silicon decomposition products.

A treatment composition 2 was also prepared comprising, relative to its total weight:

- 17% by weight of acetone solvent,
- 25% by weight of SILRES MK® (preceramic polysiloxane polymer, having a theoretical rate of conversion into ceramic into silicon dioxide SiO2 or into silicon oxycarbide Si—O—C of 80% by weight),
- 58% by weight of aluminum (active filler), whose particle size is less than 20 microns.

In this other example, the weight ratio of active filler/preceramic polymer greater than 2 (here 58/25 or 2.32).

The part 1 made of molybdenum or molybdenum alloy is introduced into the treatment composition 2 at a speed of 10 mm/min, maintained for 30 seconds in the formulation, then exited at a speed of 10 mm/min.

Figure 7:
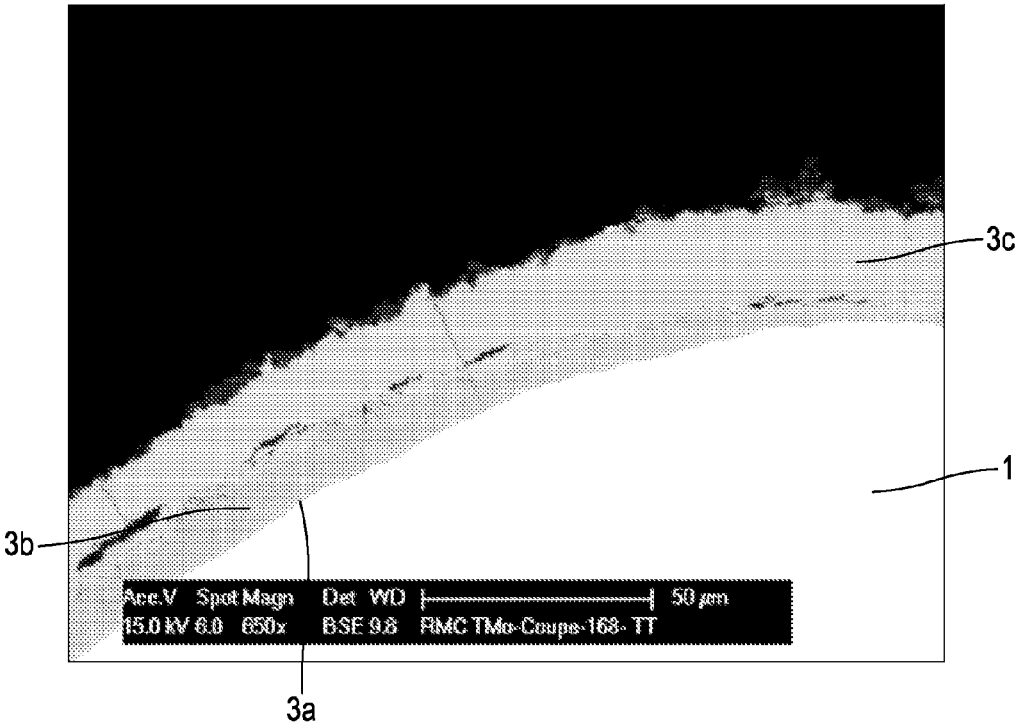
FIG. 7 is a sectional view using a scanning electron microscope of a second part obtained by a method according to the invention.

FIG. 7 shows a sectional view, obtained by scanning electron microscope (SEM), of a coated molybdenum rod 1, after four successive dippings with intermediate hot air drying followed by a heat treatment identical to that of example 1.

The ceramic portion 4 made of silicon oxycarbide (Si—O—C) with a thickness of less than 40 μm was removed by mechanical action (sandblasting).

The layer 3 of the coating is composed of three main alloy phases (listed from the rod 1 outwards):

- a continuous layer 3*a* of solid solution of aluminum and silicon in molybdenum (<2 microns).

The Al content in this layer is less than 35 atomic % and the silicon content less than 25 atomic %;

- a layer 3*b* less than 15 microns of binary alloy $Al_8Mo_3$ resulting from the reactivity between the active filler and the molybdenum support.
- a layer 3*c* comprised between 10 and 25 microns of ternary alloy $Mo(Si,Al)_2$ the silicon of which comes from the atmosphere of the pyrolysis of the preceramic polymer and/or its silicon decomposition products.

The invention claimed is:

1. A method for coating a refractory alloy part, comprising:

coating of at least one portion of the refractory alloy part, using a treatment composition comprising at least one type of preceramic polymer, a solvent and at least one active filler, heat treating the refractory alloy part coated with the treatment composition, the heat treatment allowing to at least partially convert the preceramic polymer to form a ceramic layer, the active filler being chosen to form, by solid or liquid diffusion, on a surface of the refractory alloy part, at least one alloy which is at least ternary resulting from a co-reactivity of the active filler with the refractory alloy part and the preceramic polymer, the at least ternary alloy forming a continuous layer between the surface of the refractory alloy part and the ceramic layer obtained by conversion, wherein the heat treatment is carried out so as to form a continuous layer of the at least ternary alloy, wherein the treatment composition comprises, relative to the total weight of the treatment composition, a weight proportion of between 40% and 66% of at least one active filler, and wherein an active filler/preceramic polymer weight ratio is greater than or equal to 2.

2. The method according to claim 1, wherein the treatment composition comprises, relative to the total weight of the treatment composition, the weight proportion of between 45% and 60% of at least one active filler and wherein the active filler/preceramic polymer weight ratio is comprised between 2 and 3.

3. The method according to claim 1, wherein said treatment composition comprises, relative to the total weight of the treatment composition, the weight proportion of between 55% and 60% of at least one active filler, and wherein the active filler/preceramic polymer weight ratio is comprised between 2 and 2.5.

4. The method according to claim 1, wherein the at least one active filler is selected from silicon powder, aluminum powder, iron powder, copper powder, cobalt powder, nickel powder, lanthanum powder, germanium powder, zirconium powder, chromium powder, titanium powder, hafnium powder, lanthanum powder and rhenium powder.

5. The method according to claim 1, wherein the preceramic polymer is selected from siloxanes, polysiloxanes which are converted into silica ($SiO_2$) or silicon oxycarbide (Si—O—C) by pyrolysis, polysilazanes or polycarbosilanes.

6. The method according to claim 1, wherein the treatment composition further comprises passive fillers, configured to modulate a thermal expansion coefficient of the at least ternary alloy layer, so as to have a difference between a thermal expansion coefficient of the refractory alloy part and the thermal expansion coefficient of the at least ternary alloy layer less than $3.10^{-6}$ $K^{-1}$.

7. The method according to claim 1, wherein the coating comprises at least one first coating step and one second consecutive coating step, and the heat treatment comprises at least one heat treatment step carried out between the first coating step and the second consecutive coating step, the heat treatment step being a crosslinking step for crosslinking the preceramic polymer(s), configured to generate an infusible polymer network capable of withstanding subsequent pyrolysis steps, the second consecutive coating step being applied to obtain a thicker treatment composition layer.

8. The method according to claim 7, wherein the treatment composition used during the second consecutive coating step has a viscosity lower than a viscosity of the treatment composition used during the first coating step.

9. The method according to one of claims 7, wherein the crosslinking step is carried out in the presence of air at a temperature greater than or equal to a highest crosslinking temperature among the different crosslinking temperatures of the different species of preceramic polymer of the treatment solution.

10. The method according to claim 1, wherein the heat treating comprises:

crosslinking at a first temperature configured to evaporate the solvent and thus accelerate the crosslinking, performing a conversion carried out at a second temperature, higher than the first, configured to convert the preceramic polymer into ceramic and eliminate the organic species, so as to obtain a ceramic having an amorphous structure, and structuring carried out at a third temperature, higher than the second temperature, configured to convert the ceramic with an amorphous structure into ceramic having a crystalline structure.

11. The method according to claim 1, wherein the heat treating is carried out under a controlled atmosphere so as to avoid oxidation of the refractory alloy part, while having an oxygen partial pressure sufficient to ensure the conversion of the preceramic polymer into oxycarbide ceramic or oxide ceramic.

12. The method according to claim 1, wherein the ceramic layer obtained by conversion is removed after the heat treatment, by mechanical or chemical action to leave only the at least ternary alloy layer.

13. A refractory alloy part, obtained by the coating method according to claim 1, wherein the refractory alloy part is coated with a continuous layer of at least one alloy which is at least ternary and which results from the co-reactivity of the active filler with the refractory alloy part and the preceramic polymer, and with a ceramic layer, and the continuous layer of at least one alloy which is at least ternary being disposed between the refractory alloy part and the ceramic layer.

14. The refractory alloy part according to claim 13, wherein the refractory alloy part is a foundry core made of refractory alloy.

15. The refractory alloy part according to claim 13, wherein the refractory alloy part is based on molybdenum.

16. The method according to claim 1, wherein the refractory alloy part is based on molybdenum.

* * * * *